United States Patent [19]

Piontkowski et al.

[11] 4,221,416

[45] Sep. 9, 1980

[54] LOG LIFTING APPARATUS

[75] Inventors: Carl F. Piontkowski, Old Saybrook; Robert E. Brugger, Torrington; Richard H. Bartley, Harwinton; Ernest J. Waldron, Jr., Torrington, all of Conn.

[73] Assignee: C & D Distributors, Inc., Old Saybrook, Conn.

[21] Appl. No.: 962,690

[22] Filed: Nov. 21, 1978

[51] Int. Cl.[3] ..... B66F 7/22

[52] U.S. Cl. ..... 294/17; 254/94

[58] Field of Search ..... 294/17; 254/94, 131; 248/346

[56] References Cited

U.S. PATENT DOCUMENTS

| | | | |
|---|---|---|---|
| 2,788,237 | 4/1957 | Misiura | 294/17 |
| 4,087,037 | 5/1978 | Vance | 294/17 |

*Primary Examiner*—James B. Marbert

[57] ABSTRACT

An apparatus for lifting logs from the ground to an elevated position in order to allow for cutting of the logs. The log lifter comprises a lever arm having one end thereof bent downwardly to form a leg, the leg having on the end thereof a detachable support tube which serves as a fulcrum about which the lever arm may pivot. The log lifting apparatus includes a first claw which is attached at the bend between the lever arm and the leg. The log lifting apparatus further includes a log gripping arm which is pivotably mounted with respect to the lever arm and which terminates in a second claw. To lift a log that is lying on the ground, the lever arm is held in the upright position and the log gripping arm is pivoted in the withdrawn position so as to be adjacent to the lever arm. The first claw is slipped under the log and the log gripping arm is then pivoted to provide for engagement of the log with the second claw. The lever arm is then pivoted, preferably by manual means, about the support tube. When the handle end of the lever arm is positioned adjacent the ground, the log is in an elevated position, the elevated position allowing for cutting of the log.

2 Claims, 3 Drawing Figures

LOG LIFTING APPARATUS

BACKGROUND OF THE INVENTION

1. Field of the Invention

The present invention relates to an apparatus for moving logs to an elevated position to provide for cutting of the logs.

2. Description of the Prior Art

In the method of cutting trees into firewood, the tree is first felled, the branches are removed and the tree is then cut into sections which may either be directly used as firewood or which may be split. After the tree is felled, the tree is quite difficult to cut and the branches are quite difficult to remove because the tree is lying on the ground. Thus, it is desirable to elevate the tree to facilitate removal of the branches and sectioning of the tree trunk.

One prior method for elevating the log is to physically lift the log and rest it on an adjacent tree stump or some other stationary article. It should be understood that a great deal of effort is involved in lifting the log, The log, including branches, is an extremely heavy and awkward object to move. In order to avoid lifting logs manually, log lifting apparatus have been developed. One prior art log lifting apparatus comprises an elongated lever arm including a first claw means attached to the end of a lever arm. A log gripping arm is pivotly mounted with respect to the elongated lever arm, the log gripping arm means including a second claw for engaging the log. The lever arm includes at one end thereof a leg which extends transverse to the elongated lever arm, the leg having a complicated structure. The leg includes a plurality of supporting beams which are welded to the lever arm at one end and which are also welded to a support tube which rests on the ground and which serves as a fulcrum about which a lever arm may pivot. It should be understood that this prior art lifting apparatus is quite complex and difficult to manufacture in that the leg is formed from a plurality of supporting beams which are welded to the support tube and to the elongated lever arm. Moreover, the prior art log lifting apparatus has a further disadvantage. The apparatus is bulky and requires a large packaging carton.

It is an object of the present invention to provide a log lifting apparatus which is relatively simple in construction and which can be disassembled to allow storage and shipment of the log lifting apparatus in relatively thin cartons.

SUMMARY OF THE INVENTION

The present invention provides a log lifting apparatus which allows for the lifting of logs. The log lifting apparatus comprises a lever arm which is bent downwardly to form a leg. The end of the leg has affixed thereto a detachable support tube which functions as a fulcrum about which the lever arm may pivot to lift the log. The leg of the lever arm includes a first claw and the lever arm includes a hinged log gripping arm which is pivotable with respect to the lever arm. The log gripping arm terminates in a second claw. In the method of lifting the log, the lever arm is held in the upright position and the first claw is slid beneath one side of the log. The log gripping arm is pivoted so as to engage the log with the second claw. The lever arm is moved, preferably by manual force, toward the ground. The lever arm pivots about the support tube and the log is lifted to an elevated position.

It is preferred that the support tube be positioned transverse to the lever arm and that the support tube be detachable so as to allow compact shipping and storage of the log lifting apparatus. Similarly, it is desirable that the pivotable log gripping arm be removable from the lever arm so as to allow convenient shipping and storage of the apparatus.

Although the angle of the leg of the lever arm may vary with respect to the elongated portion of the lever arm, it is particularly preferred that the angle be less than 90° in order to provide for increased mechanical advantage.

DETAILED DESCRIPTION OF THE INVENTION

Figure 1:
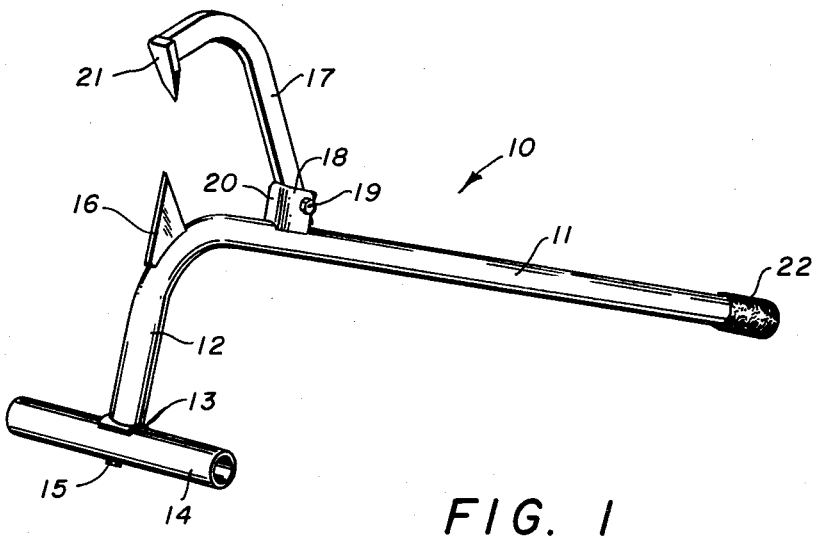
FIG. 1 is a perspective view of the apparatus for lifting logs.

Log lifting apparatus 10 comprises elongated lever portion 11 bent downwardly to form leg 12. The end of leg 12 has welded thereto an arcuately shaped retaining plate 13 which is adapted to engage support tube 14. Preferably, support tube 14 is detachably mounted on plate 13 by means of a nut 15 which engages plate 13. Preferably, elongated lever arm 11, leg 12 and support tube 14 are made from tubular steel. A claw 16 having a generally triangular shape is welded to the lever 11. The base of claw 16 preferably extends in parallel relation to the leg 12. Claw 16 grips one portion of a log which is to be lifted.

Log gripping arm 17 is pivotably mounted to elongated lever arm 11 at a point spaced from claw 16. Log gripping arm 17 is pivotably mounted on elongated lever arm 11 by a bolt 19 which is rotatably positioned in support plate 18 and which is affixed to one end of log gripping arm 17. It should be understood that support plate 18 is a U-shaped plate of steel. Two sides of the U-shaped plate of steel provide for insertion of bolt 19 and the third side 20 of the U-shaped plate 18 functions as a stop for log gripping arm 17. The function of stop means 20 will be described hereinafter. Log gripping arm 17 has an L-shape and terminates in a second claw 21. The lever 11 may include at its end a rubber grip 22.

Figure 2:
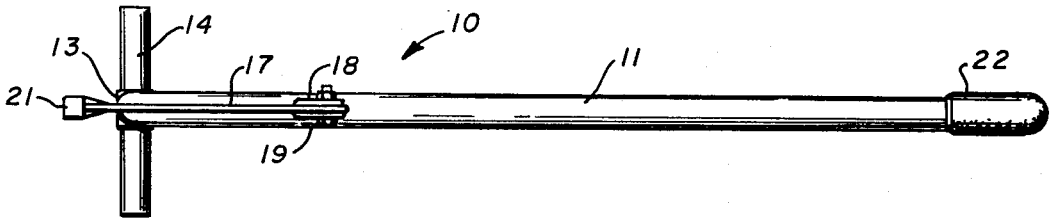
FIG. 2 is a top elevational view of the apparatus shown in FIG. 1.
Figure 3:
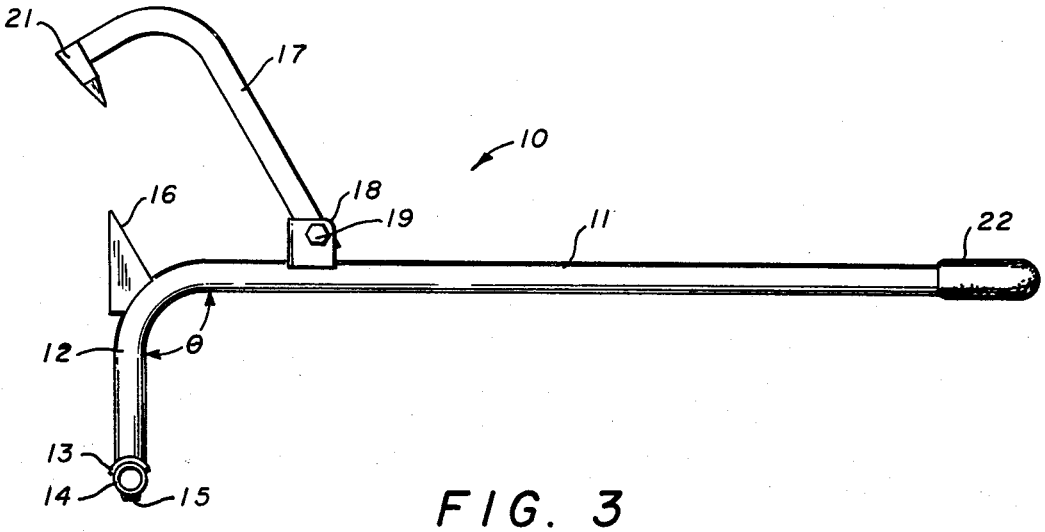
FIG. 3 is a side elevational view of the apparatus shown in FIGS. 1 and 2.

In the method of lifting a log, elongated lever 11 is aligned in the upright or vertical position and log gripping arm 17 is pivoted to a position adjacent the lever arm 11. Thus, as shown in FIG. 3, the log gripping arm 17 would be rotated clockwise with respect to lever arm 11. The first claw 16 is then slipped underneath one side of the log and the log gripping arm 17 is then pivoted in the counterclockwise direction to a position shown in FIGS. 1, 2 and 3. The second claw 21 engages the other portion of the log. In order to move the log to the elevated position, the end of elongated lever 11 is rotated from the vertical position toward the horizontal position by gripping the handle 22 and forcing the handle downwardly. The log lifting apparatus pivots about support tube 14, support tube 14 functioning as a fulcrum about which the log pivots. As the lever arm 11 is moved from the vertical to the horizontal position, the log gripping arm 17 is urged toward the first claw 16.

However, stop 20, which is formed by one side of U-shaped plate 18, prevents further movement of log gripping arm 17 at a predefined angle. In order to provide for increased mechanical advantage to lift the log, it is preferred that the angle, $\theta$, between leg 12 and lever arm 11 be less than 90°.

In order to allow for compact shipment and storage of the log lifting apparatus, support tube 14 may be detached from leg 12 by unscrewing bolt 15. Likewise, by unscrewing bolt 19 log gripping arm 17 can be removed from lever arm 11. Thus, the log lifting device may be shipped and stored in a relatively flat, compact carton.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. An apparatus for lifting logs comprising:

an elongated lever arm, said lever arm having first and second linear portions interconnected by an arcuate portion, said first linear portion being of greater length than said second linear portion, said arcuate portion transcribing an angle of less than 90°, the axes of said linear portions and said arcuate portion lying in a common plane;

a first claw rigidly attached to said lever arm arcuate portion, said first claw extending from said lever arm to the outside of said arcuate portion and terminating in a log engaging point;

an elongated foot, said foot being removably attached to the free end of said second linear portion of said lever arm and defining a fulcrum about which the log lifting apparatus pivots, said foot having an axis oriented generally transversely with respect to said common plane; and log gripping means pivotally mounted on said lever arm first linear portion intermediate the ends thereof, said log gripping arm means including a movable second claw having a log engaging point, said first claw engaging one portion of a log and said log gripping arm means being capable of pivoting with respect to said lever arm to cause said second claw to engage another portion of the log whereby the log may subsequently be raised and lowered by application of force to the first linear portion of said lever arm adjacent the free end thereof.

2. The apparatus of claim 1 wherein said log gripping arm means comprises:

a second arm, said second arm having first and second linear portions interconnected by an arcuate portion;

a plate affixed to a first end of said second arm, said plate defining said second claw;

a generally U-shaped support affixed to said elongated lever arm first linear portion, the second end of said second arm being received between two spaced sides of said support, the third side of said support defining a stop to limit motion of said second arm and second claw in the direction of said first claw; and pivot means supported in said two spaced sides of said support, said pivot means extending through said second arm adjacent the second end thereof.

* * * * *